US009280897B2

(12) United States Patent
Miller

(10) Patent No.: US 9,280,897 B2
(45) Date of Patent: Mar. 8, 2016

(54) EMERGENCY TRAFFIC MANAGEMENT SYSTEM

(71) Applicant: Siemens Industry, Inc., Alpharetta, GA (US)

(72) Inventor: David Dodd Miller, Austin, TX (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 20 days.

(21) Appl. No.: 14/326,857

(22) Filed: Jul. 9, 2014

(65) Prior Publication Data

US 2015/0015420 A1 Jan. 15, 2015

Related U.S. Application Data

(60) Provisional application No. 61/845,083, filed on Jul. 11, 2013.

(51) Int. Cl.

*G08G 1/095* (2006.01)
*G08G 1/0967* (2006.01)
*G08G 1/01* (2006.01)

(52) U.S. Cl.

CPC ..... *G08G 1/095* (2013.01); *G08G 1/096716* (2013.01); *G08G 1/096758* (2013.01); *G08G 1/096775* (2013.01); *G08G 1/096783* (2013.01); *G08G 1/0112* (2013.01); *G08G 1/0116* (2013.01); *G08G 1/0133* (2013.01); *G08G 1/0145* (2013.01)

(58) Field of Classification Search

None

See application file for complete search history.

(56) References Cited

U.S. PATENT DOCUMENTS

| | | | | |
|---|---|---|---|---|
| 8,718,797 | B1 * | 5/2014 | Addepalli | H04W 4/046 700/17 |
| 2009/0112582 | A1 * | 4/2009 | Kuwagaki | G08G 1/09685 704/225 |
| 2009/0296680 | A1 * | 12/2009 | Suzuki | H04W 72/0406 370/342 |
| 2010/0156670 | A1 * | 6/2010 | Hamilton, II | G07B 15/06 340/928 |
| 2010/0198455 | A1 * | 8/2010 | Hotta | G08G 1/20 701/31.4 |
| 2011/0034201 | A1 * | 2/2011 | Hamada | H04L 67/12 455/517 |
| 2011/0068950 | A1 * | 3/2011 | Flaherty | G08G 1/096 340/905 |
| 2011/0102194 | A1 * | 5/2011 | Kinoshita | G01C 21/26 340/905 |
| 2011/0260886 | A1 * | 10/2011 | Nagura | G08G 1/096783 340/905 |
| 2012/0059574 | A1 * | 3/2012 | Hada | G08G 1/0112 701/119 |
| 2013/0018705 | A1 * | 1/2013 | Heath | G08G 1/017 705/13 |
| 2013/0301584 | A1 * | 11/2013 | Addepalli | H04W 4/046 370/329 |
| 2015/0264554 | A1 * | 9/2015 | Addepalli | H04W 4/046 370/328 |

* cited by examiner

*Primary Examiner* — Julie Lieu

(57) ABSTRACT

Embodiments include an emergency traffic management system includes a traffic management center configured to receive traffic information, a traffic signal controller in communication with the traffic management center, and roadside equipment in communication with the traffic signal controller. The roadside equipment includes a transceiver configured to communicate with one or more mobile devices via a wireless communications channel, a memory device configured to store emergency information, a processor configured to provide the emergency information to the one or more mobile devices via the transceiver, and a power supply configured to provide power to the processor and the transceiver.

19 Claims, 3 Drawing Sheets

EMERGENCY TRAFFIC MANAGEMENT SYSTEM

CROSS REFERENCE TO RELATED APPLICATIONS

This application claims the benefit of Provisional Application No. 61/845,083 filed on Jul. 11, 2013 in the United States Patent and Trademark Office, the contents of which are herein incorporated by reference in its entirety.

BACKGROUND

The present invention relates generally to a traffic management system and more specifically to, an emergency traffic management system having roadside equipment.

In general, traffic management systems collect information regarding traffic conditions and provide a summary of the collected traffic information to the public. Currently available traffic management systems include variable message signs that are disposed along roadways. These variable message signs are used to advise drivers of current driving conditions, expected drive times, road closures, accidents, or the like. In large scale emergency situations, such as during natural disasters, the variable message signs may be damaged or be otherwise unavailable due to power outages or damage to communications equipment connecting the signs to the traffic management system.

In addition, the traffic management systems include websites that can be accessed by the public to view the summary of the collected traffic information. Accordingly, drivers can use mobile devices, such as smart phones and tablets to obtain traffic information to plan their routes and avoid delays. In large scale emergency situations, such as during natural disasters, it is common for the cellular networks to become unavailable due to power outages, damage to cellular towers, and large spikes in user demand. Accordingly, it may be difficult, if not impossible, for users of mobile devices that rely on the cellular network to access the traffic management system via the cellular network.

SUMMARY

According to one embodiment, an emergency traffic management system includes a traffic management center configured to receive traffic information, a traffic signal controller in communication with the traffic management center, and roadside equipment in communication with the traffic signal controller. The roadside equipment includes a transceiver configured to communicate with one or more mobile devices via a wireless communications channel, a processor configured to provide the emergency information to the one or more mobile devices via the transceiver, and a power supply configured to provide power to the processor and the transceiver.

According to another embodiment, a roadside equipment device includes a transceiver configured to communicate with one or more mobile devices via a wireless communications channel, a memory device configured to store emergency information, a processor configured to provide the emergency information to the one or more mobile devices via the transceiver, and a power supply configured to provide power to the processor and the transceiver.

According to yet another embodiment, a method for operating an emergency traffic management system includes receiving information regarding traffic conditions. The method also includes analyzing collected traffic information and providing data regarding traffic conditions and monitoring an availability of a cellular network in a vicinity of roadside equipment. The method also includes determining if the cellular network available in the vicinity of the roadside equipment. Based upon determining the cellular network in the vicinity of the roadside equipment is not available, the method includes operating the roadside equipment as a Wi-Fi hotspot to provide information regarding traffic conditions. Based upon determining the cellular network in the vicinity of the roadside equipment is available, the method includes operating the roadside equipment in a normal state.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
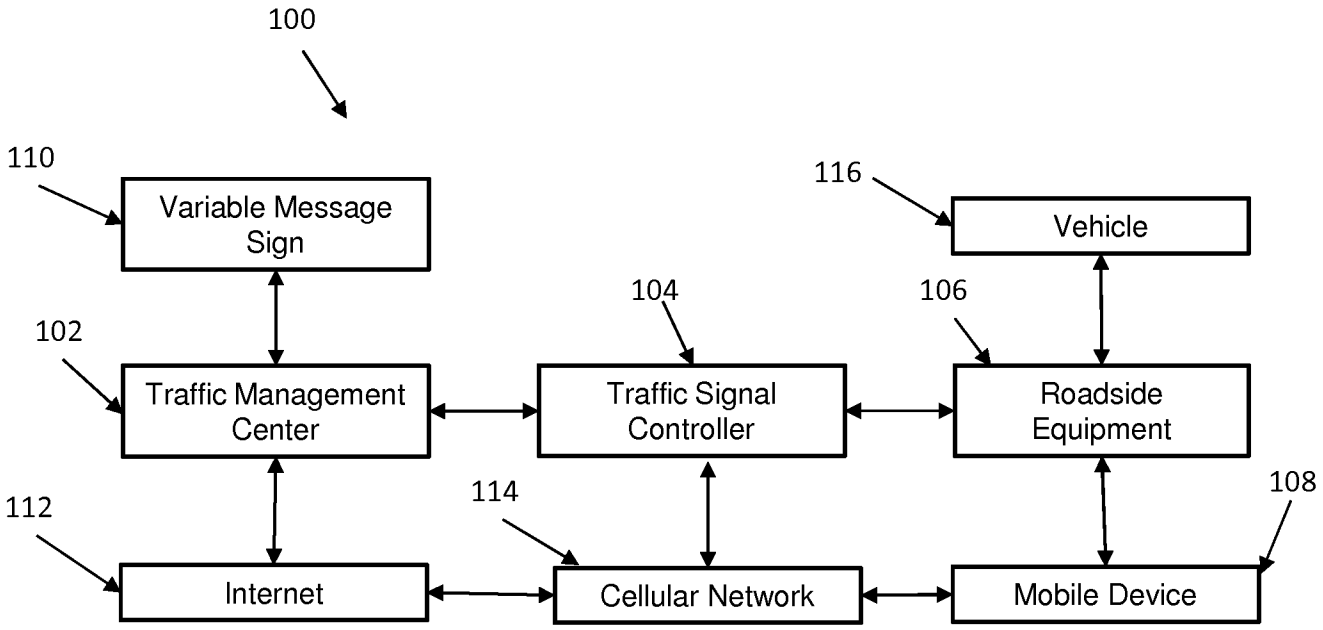
FIG. 1 illustrates a block diagram of an emergency traffic management system in accordance with an exemplary embodiment.

Referring now to FIG. 1, a block diagram of an emergency traffic management system 100 in accordance with an exemplary embodiment is shown. As illustrated, the emergency traffic management system 100 includes a traffic management center 102 which is configured to receive and analyze traffic information. In exemplary embodiments, the traffic management center 102 is configured to provide data regarding the traffic information via a variable message sign 110 and over the Internet 112 via a website. During normal operations, the traffic management center 102 may use the variable message signs 110 to provide expected travel times. In addition, the traffic management center 102 may provide a website having congestion maps on the Internet 112 that users can access from a mobile device 108 over a cellular network 114. During large scale emergency situations, the traffic management center 102 may be configured to provide evacuation instructions to drivers via the variable message signs 110 and over the Internet 112. In exemplary embodiments, the traffic management center 102 may be a traditional physical traffic management center 102 or a cloud based traffic management center 102.

The emergency traffic management system 100 also includes one or more traffic signal controllers 104, which are connected to the traffic management center 102. In exemplary embodiments, the management center 102 may be connected to the traffic signal controller 104 by a fiber optic cable, copper wire, or by other suitable means. The traffic signal controllers 104 are configured to communicate with the traffic management center 102 and to control one or more traffic signals. In exemplary embodiments, the traffic signal controllers 104 may receive signal control plans from the traffic management system 100 which are used to govern the operation of the traffic signals.

In exemplary embodiments, the emergency traffic management system 100 also includes roadside equipment 106 that is connected to the traffic signal controller 104. In one embodiment, the roadside equipment 106 may be connected to the traffic signal controller 104 via an Ethernet connection, or another suitable electrical connection. In exemplary embodiments, the roadside equipment 106 is configured to communicate with vehicles 116 and with mobile devices 108. In exemplary embodiments, the roadside equipment is enclosed with a watertight and weatherproof enclosure.

During large scale emergency situations, such as during natural disasters, both the variable message signs 110 and the cellular network 114 may experience outages or failures. As a result, drivers may not be able to access the traffic management center 102 via the cellular network 114 or receive evacuation instructions, congestion information and the like from the variable message signs 110 or over the cellular network 114. In exemplary embodiments, the roadside equipment 106 is configured to communicate directly with mobile devices 108 to provide people in the vicinity of the roadside equipment 106 with access to evacuation instructions, congestion information and the like. In one embodiment, the roadside equipment 106 is configured to act as a Wi-Fi hotspot that is accessible by mobile device 108. In another embodiment, the roadside equipment may capable of communication with nearby with mobile devices 108 via Bluetooth, or the like.

Figure 2:
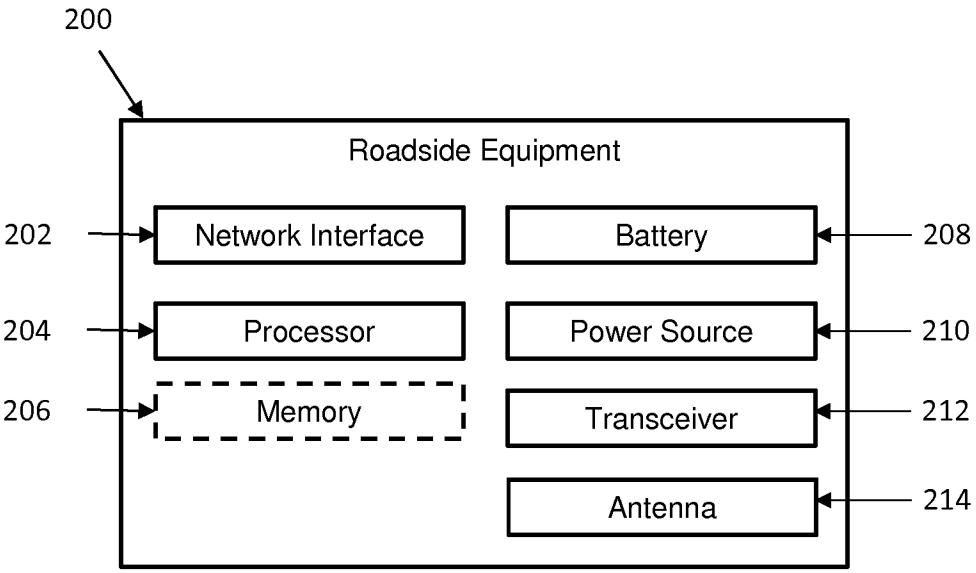
FIG. 2 illustrates a block diagram of roadside equipment in accordance with an exemplary embodiment.

Referring now to FIG. 2, a block diagram of roadside equipment 200 in accordance with an exemplary embodiment is shown. As illustrated, the roadside equipment 200 includes a network interface 202, a processor 204, a memory 206, a battery 208, a power source 210, a transceiver 212, and an antenna 214. In one embodiment, the network interface 202 is configured to connect the roadside equipment 200 to a traffic signal controller via an Ethernet cable. The roadside equipment 200 is configured to receive information from the traffic signal controller and to use the processor 204 and the memory 206 to process and store the received information. For example, the roadside equipment 200 may receive a congestion map and store the congestion map in memory 206. In addition, the roadside equipment 200 may use the processor 204 to respond to requests from mobile devices for the stored congestion map. In exemplary embodiments, the memory 206 may include any of a wide variety of memory devices including volatile and non-volatile memory devices.

In exemplary embodiments, the roadside equipment 200 is configured to receive power from power source 210 and to charge a battery 208. The battery 208 is configured to provide power to the roadside equipment 200 in the event of an interruption or failure of the power source 210. In exemplary embodiments, the power source 210 may be a power over Ethernet power source and the network interface 202 may be configured to receive both data and power over an Ethernet connection. In exemplary embodiments, the battery 208 may be a lead acid battery, a lithium ion battery, a nickel cadmium battery or the like. In addition, the power could be supplied by wind, solar or fuel cell.

In exemplary embodiments, the roadside equipment 200 includes multiple transceivers 212 and antennas 214 which are each configured to communicate on different communications channels, or frequencies. In one embodiment, the roadside equipment 200 includes three transceivers 212 and three antennas 214. In other embodiments, the roadside equipment 200 may be configured to use a single antenna 214 and transceiver 212 to communicate over a range of communications channels, or frequencies.

In one embodiment, a first transceiver 212 and antenna 214 are configured to operate as a Wi-Fi hotspot and to communicate via the IEEE 802.11 standards. In exemplary embodiments, the roadside equipment 200 is configured to broadcast emergency and other messages via Wi-Fi to nearby drivers and pedestrians during cellular outages and during a loss of power to variable message signs. In exemplary embodiments, the Wi-Fi hotspot provided by the roadside equipment 200 is configured to only provide access to a website generated by the traffic management center which contains traffic and emergency information. In other words, the Wi-Fi hotspot may not be configured to provide access to the Internet.

In exemplary embodiments, the roadside equipment 200 may be configured to continuously act as a Wi-Fi hotspot or may be configured to only operate as a Wi-Fi hotspot once the roadside equipment 200 determines that the cellular network in the vicinity of the roadside equipment 200 is unavailable. In one embodiment, the roadside equipment 200 may receive instructions to turn on from the traffic management center. For example, the traffic management center may be configured to monitor the availability of a cellular network in the vicinity of the roadside equipment 200 and upon noticing an outage of the cellular network the traffic management center may instruct the roadside equipment 200 to act as a Wi-Fi hotspot. In anther embodiment, the roadside equipment 200 may be configured to monitor the availability of the cellular network in the vicinity of the roadside equipment 200.

In exemplary embodiments, a second transceiver 212 and antenna 214 is configured to communicate via a service channel to communicate with emergency vehicles such as ambulances, fire trucks, police vehicles, or the like. In exemplary embodiments, the service channel may be configured to receive communications from nearby emergency vehicles, such as receiving patient vital signs from an ambulance.

In exemplary embodiments, a third transceiver 212 and antenna 214 is configured to communicate via a control channel to communicate with non-emergency vehicles. In exemplary embodiments, the control channel may be used for low latency control information for nearby vehicles, such as driver warnings or automatic braking if a drive is distracted and about to run a red light. In another embodiment, a third transceiver 212 may be configured to receive communications from a satellite communications system and antenna 214 may be configured rebroadcast the communications received from a satellite communications system.

In exemplary embodiments, one of the transceivers 212 and antennas 214 of the roadside equipment 200 is configured to communicate with a cellular telephone network in the vicinity of the roadside equipment 200. The roadside equipment 200 may be configured to periodically determine if the cellular telephone network in the vicinity of the roadside equipment 200 is available. In one embodiment, upon detection that the cellular telephone network in the vicinity of the roadside equipment 200 is unavailable, the roadside equipment 200 may be configured to notify the traffic management center of the outage of the cellular telephone network. In another embodiment, upon detection that the cellular telephone network in the vicinity of the roadside equipment 200 is unavailable, the roadside equipment 200 may be configured to begin operation of a Wi-Fi hotspot.

Those of skill in the art will recognize that not all other details are shown in the simplified block diagram shown in FIG. 2. In exemplary embodiments, the antenna 214 may be dedicated to a single transceiver 212, or may be connected to be shared with other components. The transceiver 212 may be a wireless receiver, although of course it transmits data to the processor 204, or can also be a wireless transmitter. The processor 204 may be configured to perform only the processes described herein, or can also be configured to perform other processes for the operation and management the roadside equipment 200. The various components of FIG. 2 could be constructed as separate elements connected to communicate with each other or two or more of these components could be integrated into a single device.

Figure 3:
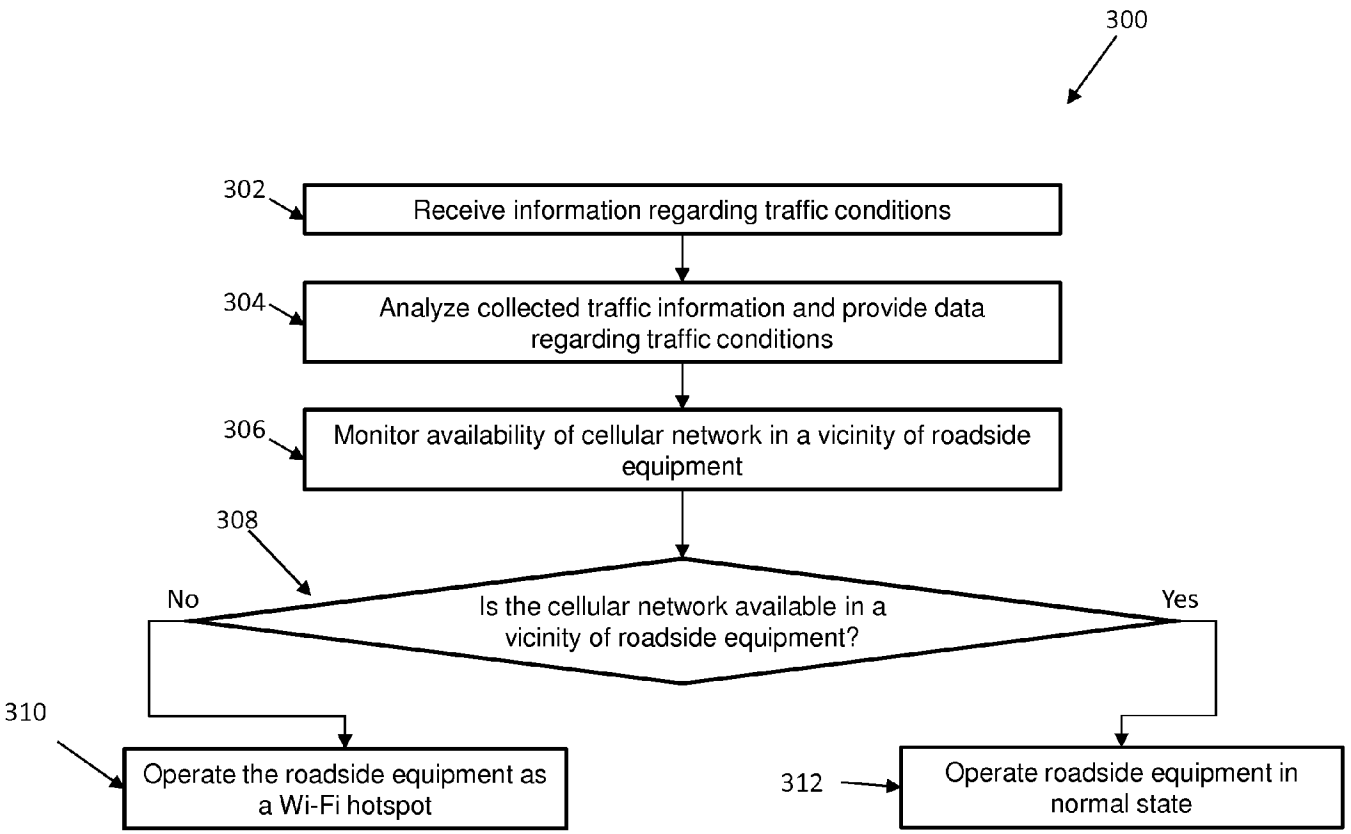
FIG. 3 illustrates a flow chart diagram of a method for operating an emergency traffic management system in accordance with an exemplary embodiment.

Referring now to FIG. 3, a flow chart diagram of a method 300 for operating an emergency traffic management system in accordance with an exemplary embodiment is provided. As illustrated at block 302, the method 300 includes receiving information regarding traffic conditions. In exemplary embodiments, this information may be received from a variety of sources that include, but are not limited to, on-road sensors (e.g. inductive loops), traffic cameras, in vehicle devices, or the like. Next, as shown at block 304, the method 300 includes analyzing collected traffic information and providing data regarding traffic conditions. In exemplary embodiments, the data regarding the traffic conditions may be provided via a website or through one or more variable message signs. In exemplary embodiments, the data regarding the traffic conditions may be transmitted to and stored on a roadside equipment device. Next, as shown at block 306, the method also includes monitoring the availability of a cellular network in a vicinity of roadside equipment. As shown at decision block 308, the method 300 includes determining if the cellular network is available in a vicinity of roadside equipment. Upon determining that the cellular network is not available, the method 300 includes operating the roadside equipment as a Wi-Fi hotspot to provide the data regarding the traffic conditions, as shown at block 310. Otherwise, as shown at block 312, the method 300 includes operating the roadside equipment in its normal state.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A roadside equipment device comprising:

a transceiver configured to communicate with one or more mobile devices via a wireless communications channel, wherein the transceiver is further configured to monitor an availability of a cellular telephone network in a vicinity of the roadside equipment device;

a processor configured to provide the emergency information to the one or more mobile devices via the transceiver, wherein the processor is configured to provide the emergency information to the one or more mobile devices via the transceiver only upon determining that the cellular telephone network in the vicinity of the roadside equipment device is not available; and a power supply configured to provide power to the processor and the transceiver.

2. The roadside equipment device of claim 1, wherein the wireless communications channel is a Wi-Fi channel.

3. The roadside equipment device of claim 1 further comprising a network interface adaptor configured to communicate with a traffic signal controller.

4. The roadside equipment device of claim 3, wherein the network interface adaptor is configured to receive power for charging the power supply from the traffic signal controller.

5. The roadside equipment device of claim 1 further comprising an antenna coupled to the transceiver.

6. The roadside equipment device of claim 1 further comprising a memory device configured to store emergency information.

7. An emergency traffic management system comprising:

a traffic management center configured to receive traffic information;

a traffic signal controller in communication with the traffic management center; and roadside equipment in communication with the traffic signal controller, the roadside equipment comprising:

a transceiver configured to communicate with one or more mobile devices via a wireless communications channel, wherein the transceiver is further configured to monitor an availability of a cellular telephone network in a vicinity of the roadside equipment;

a processor configured to provide the emergency information to the one or more mobile devices via the transceiver; and a power supply configured to provide power to the processor and the transceiver; and wherein the processor is configured to provide the emergency information to the one or more mobile devices via the transceiver only upon determining that the cellular telephone network in the vicinity of the roadside equipment is not available.

8. The emergency traffic management system of claim 7, wherein the wireless communications channel is a Wi-Fi channel.

9. The emergency traffic management system of claim 7, wherein the roadside equipment further comprises a network interface adaptor configured to communicate with a traffic signal controller.

10. The emergency traffic management system of claim 9, wherein the network interface adaptor is configured to receive power for charging the power supply from the traffic signal controller.

11. The emergency traffic management system of claim 7, wherein the roadside equipment further comprises a memory device configured to store emergency information.

12. A method for operating an emergency traffic management system comprising:

receiving information regarding traffic conditions;

monitoring an availability of a cellular network in a vicinity of a roadside equipment;

determining if the cellular network available in the vicinity of the roadside equipment;

based upon determining the cellular network in the vicinity of the roadside equipment is not available, operating the roadside equipment as a Wi-Fi hotspot to provide information regarding traffic conditions; and based upon determining the cellular network in the vicinity of the roadside equipment is available, operating the roadside equipment in a normal state.

13. The method of claim 12, further comprising storing the information regarding traffic conditions.

14. A roadside equipment device comprising:

a transceiver configured to operate as a Wi-Fi hotspot to transmit emergency information regarding traffic conditions to one or more mobile devices of drivers of vehicles being served by the roadside equipment device if the transceiver determines that a cellular telephone network in a vicinity of the roadside equipment device is not available.

15. The roadside equipment device of claim 14, further comprising:

a processor configured to provide the emergency information to the one or more mobile devices via the transceiver, wherein the processor is configured to provide the emergency information to the one or more mobile devices via the transceiver only upon determining that the cellular telephone network in the vicinity of the roadside equipment device is not available.

16. The roadside equipment device of claim 15, further comprising:

a power supply configured to provide power to the processor and the transceiver.

17. The roadside equipment device of claim 14, further comprising:

a network interface adaptor configured to communicate with a traffic signal controller.

18. The roadside equipment device of claim 17, wherein the network interface adaptor is configured to receive power for charging a power supply that provides power to the processor and the transceiver from the traffic signal controller.

19. The roadside equipment device of claim 14, further comprising:

an antenna coupled to the transceiver; and a memory device configured to store the emergency information.

* * * * *